US007951055B2

(12) United States Patent
Mulderrig et al.

(10) Patent No.: US 7,951,055 B2
(45) Date of Patent: May 31, 2011

(54) PUSH-UP BLOCKS

(76) Inventors: Edward B. Mulderrig, Sag Harbor, NY (US); Patrick F. Mulderrig, Los Angeles, CA (US)

( * ) Notice: Subject to any disclaimer, the term of this patent is extended or adjusted under 35 U.S.C. 154(b) by 0 days.

(21) Appl. No.: 12/656,690

(22) Filed: Feb. 12, 2010

(65) Prior Publication Data

US 2010/0210430 A1 Aug. 19, 2010

Related U.S. Application Data

(60) Provisional application No. 61/202,315, filed on Feb. 17, 2009.

(51) Int. Cl.
*A63B 71/00* (2006.01)

(52) U.S. Cl. ..... 482/141; 482/62

(58) Field of Classification Search ..... 482/141, 482/62, 148, 139, 34; D21/662, 665
See application file for complete search history.

(56) References Cited

U.S. PATENT DOCUMENTS

| | | | | |
|---|---|---|---|---|
| 2,817,347 | A * | 12/1957 | Hilt, Sr. | 135/65 |
| 3,115,338 | A | 12/1963 | Acs | |
| 3,686,703 | A | 8/1972 | Ray | |
| 4,351,525 | A * | 9/1982 | Rozenblad | 482/141 |
| 4,610,448 | A | 9/1986 | Hill | |
| 4,621,806 | A | 11/1986 | Wheeler | |
| 4,768,778 | A | 9/1988 | Thomas, Jr. | |
| 4,854,573 | A | 8/1989 | Johannson et al. | |
| 5,004,229 | A * | 4/1991 | Lind | 482/132 |
| 5,181,897 | A * | 1/1993 | Agan | 482/141 |
| 5,205,802 | A * | 4/1993 | Swisher | 482/141 |
| 5,226,868 | A * | 7/1993 | Montgomery | 482/141 |
| 5,230,684 | A * | 7/1993 | Wallisch | 482/141 |
| 5,330,408 | A * | 7/1994 | Westmoreland, Jr. | 482/141 |
| D354,100 | S | 1/1995 | Tsay | |
| 5,466,206 | A * | 11/1995 | Fleming | 482/141 |
| 5,527,252 | A * | 6/1996 | Sather | 482/141 |
| 5,607,380 | A * | 3/1997 | Duty | 482/141 |
| 5,713,823 | A * | 2/1998 | Walendzak et al. | 482/142 |
| 5,749,818 | A | 5/1998 | Sather | |
| 6,186,930 | B1 | 2/2001 | Ignaczak | |
| D469,484 | S | 1/2003 | Dawson | |
| 7,090,622 | B2 * | 8/2006 | Hetrick | 482/92 |
| 7,326,122 | B2 * | 2/2008 | Park | 473/256 |
| 7,357,766 | B2 | 4/2008 | Langer et al. | |
| 7,367,928 | B2 * | 5/2008 | Storch | 482/141 |

(Continued)

FOREIGN PATENT DOCUMENTS

GB 2 220 636 A 3/1994

(Continued)

*Primary Examiner* — Lori Baker
(74) *Attorney, Agent, or Firm* — Richard C. Litman

(57) ABSTRACT

The push-up block is a device that provides the user with a handgrip for use during push-up exercises, and which further expands the range of exercises and the associated benefits associated with conventional push-ups. The push-up block includes an upper member, having opposed upper and lower surfaces, and a lower member also having opposed upper and lower surfaces. A handle is secured to the upper surface of the upper member, providing the user with a handgrip. The lower surface of the lower member is convex so that at least one lowest point thereof contacts a support surface when the push-up block is in use. For example, the lower surface may be substantially V-shaped, forming a triangular wedge, substantially semicircular or arcuate, or may be substantially pyramidal.

19 Claims, 6 Drawing Sheets

U.S. PATENT DOCUMENTS

| | | | | |
|---|---|---|---|---|
| 7,377,888 | B2 | 5/2008 | Godbold | |
| D579,503 | S | 10/2008 | Hauser | |
| 7,468,025 | B2 | 12/2008 | Hauser et al. | |
| 7,481,753 | B2 | 1/2009 | James et al. | |
| D585,947 | S | 2/2009 | Royster | |
| 7,503,884 | B1 | 3/2009 | Schall | |
| 7,553,267 | B1 | 6/2009 | Hauser et al. | |
| D597,153 | S | 7/2009 | Friedman et al. | |
| D599,417 | S | 9/2009 | Friedman et al. | |
| 7,585,262 | B1 * | 9/2009 | Vayntraub | 482/141 |
| 7,604,582 | B2 * | 10/2009 | Abdallah | 482/141 |
| 7,780,575 | B1 * | 8/2010 | Goodwin et al. | 482/34 |
| 2005/0085352 | A1 * | 4/2005 | Baxter | 482/100 |
| 2005/0148448 | A1 * | 7/2005 | Mersch | 482/141 |
| 2006/0014615 | A1 | 1/2006 | Godbold | |
| 2006/0035771 | A1 | 2/2006 | Gant | |
| 2007/0298947 | A1 * | 12/2007 | Eksteen | 482/141 |
| 2009/0247378 | A1 * | 10/2009 | Carlesimo et al. | 482/141 |
| 2010/0004105 | A1 * | 1/2010 | Peddar | 482/132 |
| 2010/0087301 | A1 * | 4/2010 | Juncker | 482/146 |
| 2010/0210430 | A1 * | 8/2010 | Mulderrig et al. | 482/141 |
| 2010/0210431 | A1 * | 8/2010 | Hinton et al. | 482/141 |

FOREIGN PATENT DOCUMENTS

| | | | |
|---|---|---|---|
| GB | 2 270 636 | A | 3/1994 |
| WO | WO 94/17864 | A1 | 8/1994 |

* cited by examiner

PUSH-UP BLOCKS

CROSS-REFERENCE TO RELATED APPLICATION

This application claims the benefit of U.S. Provisional Patent Application Ser. No. 61/202,315, filed Feb. 17, 2009.

BACKGROUND OF THE INVENTION

1. Field of the Invention

The present invention relates to exercise devices, and more particularly to a push-up block that provides the user with a handgrip for use during push-up exercises.

2. Description of the Related Art

A push-up is a common strength training exercise performed in a prone position, lying horizontal and face-down, raising and lowering the body using the arms. Push-ups develop the pectoral muscles and triceps, with ancillary benefits to the deltoids, serratus anterior, coracobrachialis and the midsection as a whole. Push-ups are a basic exercise used in civilian athletic training or physical education and, especially, in military physical training.

Although various handgrips for use in performing push-ups are well known in the art, such grips typically only provide stability and frictional engagement with the ground, thus providing no benefits beyond those of conventional push-ups.

Although conventional push-ups, either performed with the exerciser's hands positioned directly on the ground or using the aforementioned prior art grips, exercise the triceps and pectoral muscles, they do not typically aid in strengthening the exerciser's core muscles, wrists, or rotator cuffs, or provide exercise for the user's general sense of balance. It would be desirable to provide a device that may be easily used to expand the range of benefits provided by conventional push-ups. Thus, a push-up block solving the aforementioned problems is desired.

SUMMARY OF THE INVENTION

The push-up block is a device which provides the user with a handgrip for use during push-up exercises, and which further expands the range of exercises and the associated benefits associated with conventional push-ups. The push-up block includes an upper member, having opposed upper and lower surfaces, and a lower member also having opposed upper and lower surfaces. A handle is secured to the upper surface of the upper member, providing the user with a handgrip.

The lower surface of the lower member is convex so that at least one lowest point thereof contacts a support surface when the push-up block is in use. For example, the lower surface may be substantially V-shaped, forming a triangular wedge, or may be substantially semicircular or arcuate, or may be substantially pyramidal, presenting different bearing surfaces against the floor that require use of different muscle groups when performing push-ups.

Preferably, a pair of push-up blocks are provided so that the user may perform push-up exercises with both hands. Additionally, the upper surface of the lower member is preferably releasably and removably attached to the lower surface of the upper member. Each push-up block may be provided as a kit, with a single upper member and a plurality of lower members, with each lower member having a distinctive contour. The user may then remove, replace and interchange the lower members, depending upon the type of exercise in which the user wishes to engage.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
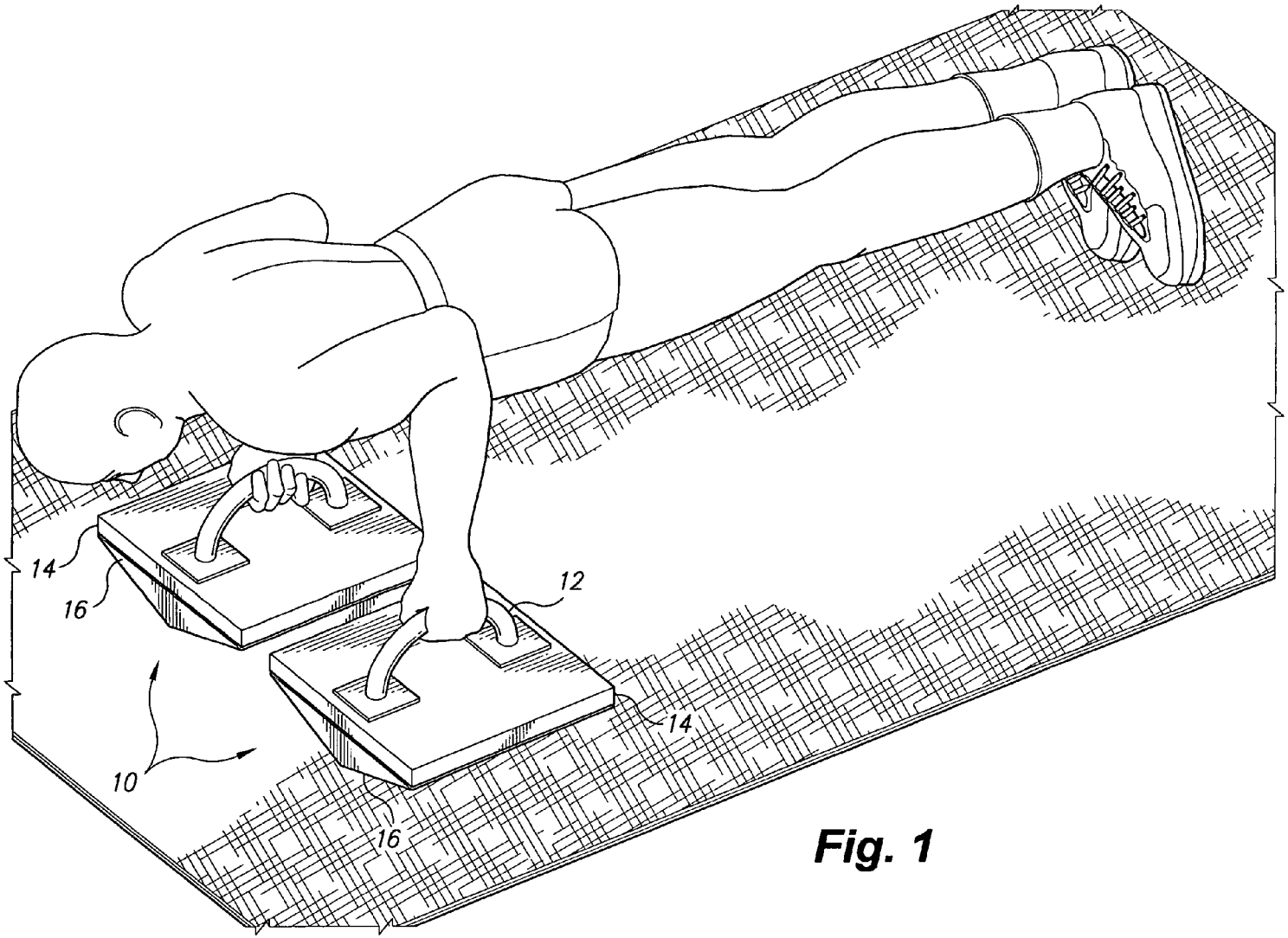
FIG. 1 is an environmental, perspective view of a pair of push-up blocks according to the present invention.

Now referring to FIG. 1, the push-up block 10 is a device that provides the user with a hand grip for use during push-up exercises, as shown, and which further expands the range of exercises and the associated benefits associated with conventional push-ups. As shown in FIG. 1 a pair of push-up blocks 10 are preferably provided so that the user may perform push-up exercises with both hands.

Figure 2A:
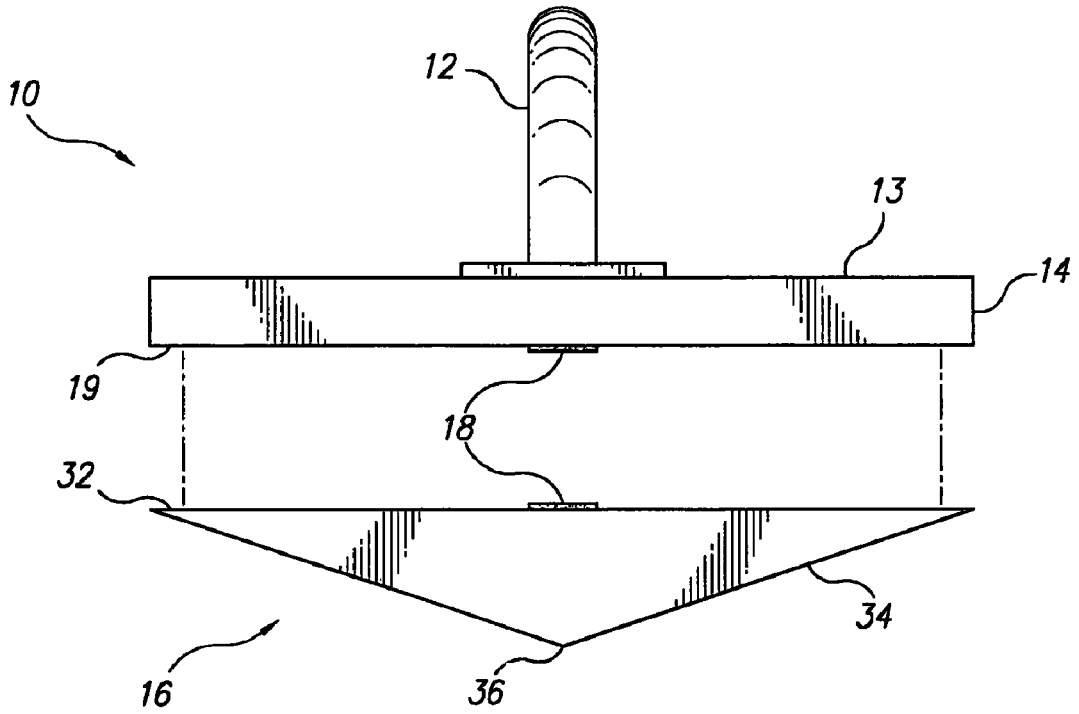
FIG. 2A is a partially exploded front view of a push-up block according to the present invention.
Figure 2B:
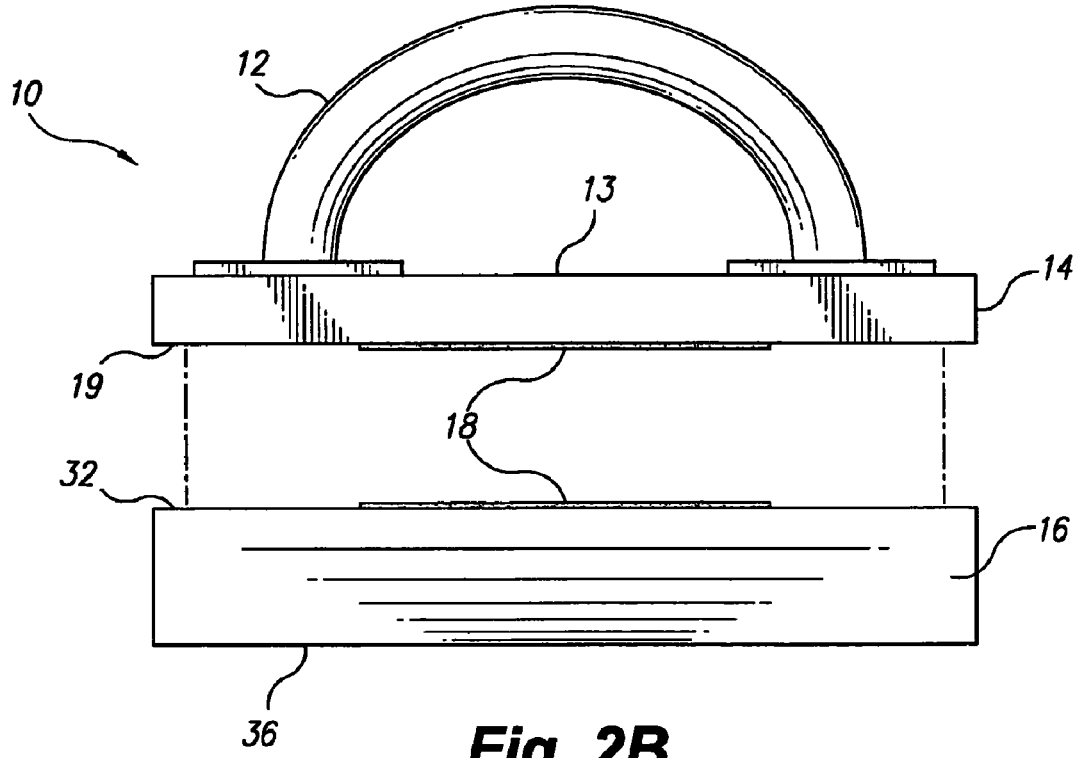
FIG. 2B is a partially exploded side view of the push-up block of FIG. 2A.

As best shown in FIG. 2A and FIG. 2B, the push-up block 10 includes an upper member 14, which is essentially a platform having a handle extending therefrom. The upper member 14 has opposed upper and lower surfaces 13, 19, respectively. A base or lower member 16 also has opposed upper and lower surfaces 32, 34, respectively. The handle 12 is secured to the upper surface 13 of the upper member 14, providing the user with a handgrip. Upper member 14 and lower member 16 may be formed from any suitable material having the strength to support the user, and which is also lightweight enough to be easily portable, such as plastic, aluminum, etc. Handle 12 may be integrally formed with upper member 14, as a one-piece, molded plastic piece, or may, alternatively, be releasably secured thereto through the usage of any suitable releasable fastener. As a further alternative, handle 12 may be selectively foldable against upper surface 13 for ease of transport and storage. Additionally, it should be understood that in addition to handle 12 being formed integrally with the upper member, the lower member may further be formed integrally with the upper member. In this alternative, the entire push-up block is formed as an integral, one-piece unit. Handle 12 is preferably formed or coated with a comfortable, frictionally engaging material, such as rubber or the like.

The lower surface 34 of the lower member 16 may have various shapes, but is convex so that at least one lowest point thereof contacts the support surface when the push-up block 10 is in use. Each of the upper and lower members may be rectangular when viewed from above, as shown, with exemplary dimensions including a width of approximately six inches and a length of approximately twelve inches. It should be understood that the dimensions and shape may be varied without departing from the spirit or scope of the present invention. In FIGS. 2A and 2B, the lower surface 34 may be substantially V-shaped, forming a triangular wedge, with vertex 36 resting on the ground during use. The contacting surface of the lower member is preferably formed from, or coated with, a non-skid material, such as rubber or the like, for frictionally engaging the support surface.

Figure 3A:
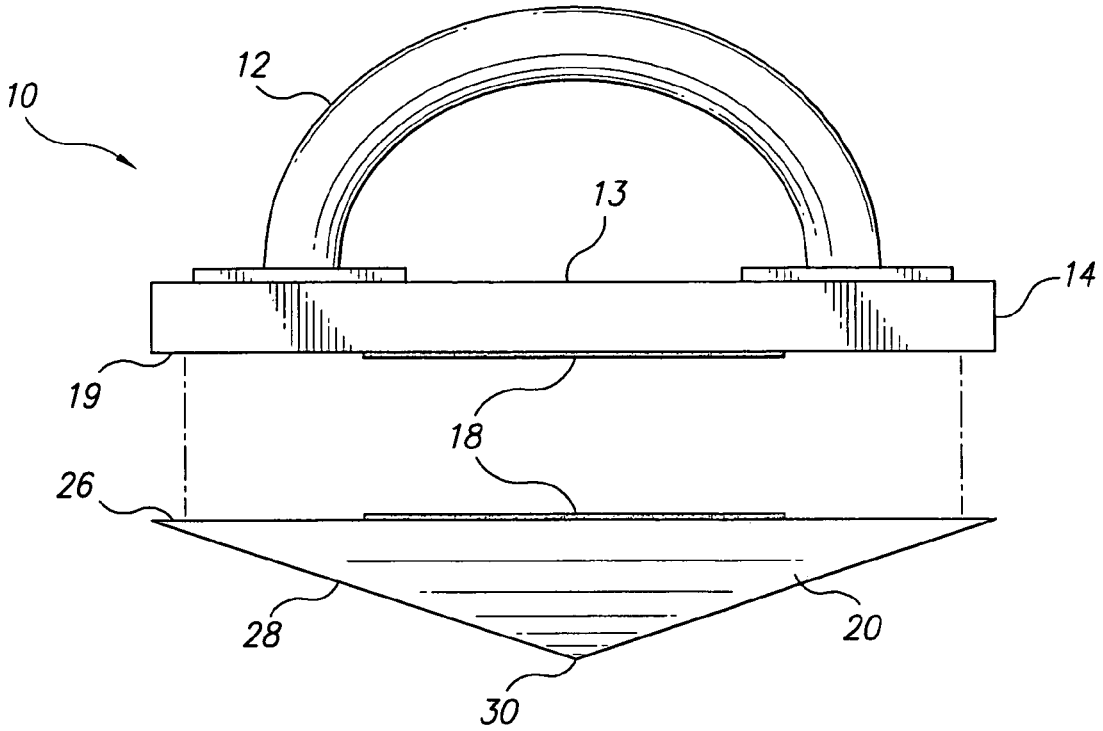
FIG. 3A is a partially exploded front view of an alternative embodiment of a push-up block according to the present invention.
Figure 3B:
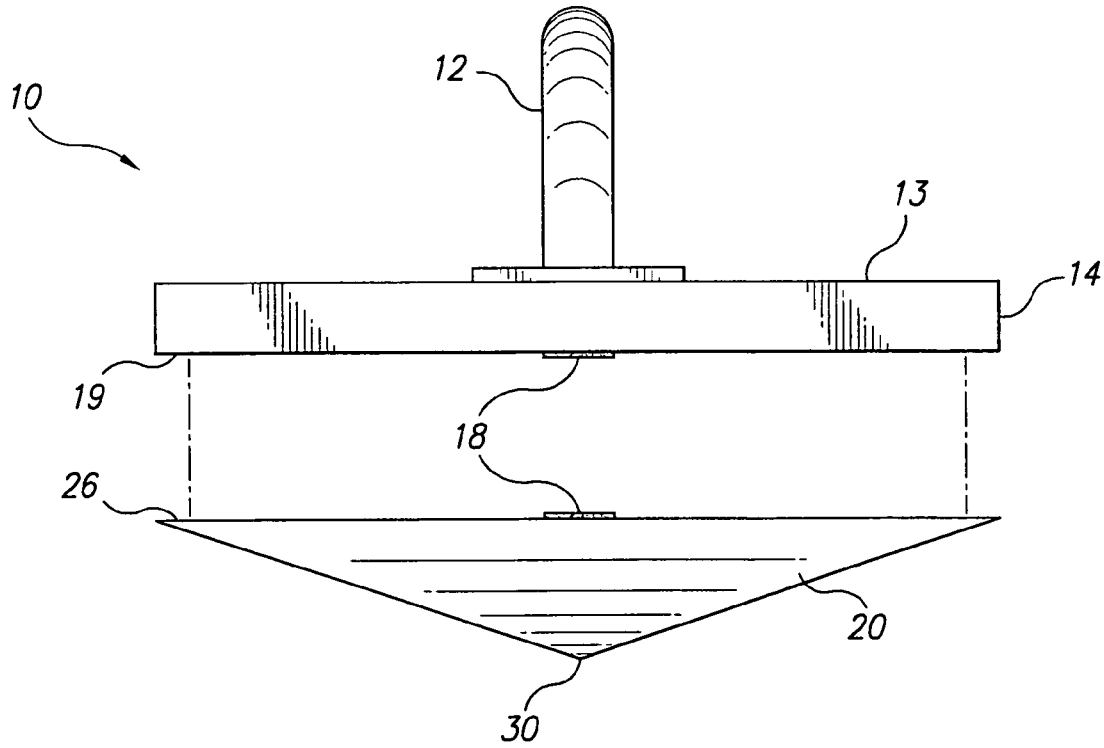
FIG. 3B is a partially exploded side view of the push-up block of FIG. 3A.
Figure 4A:
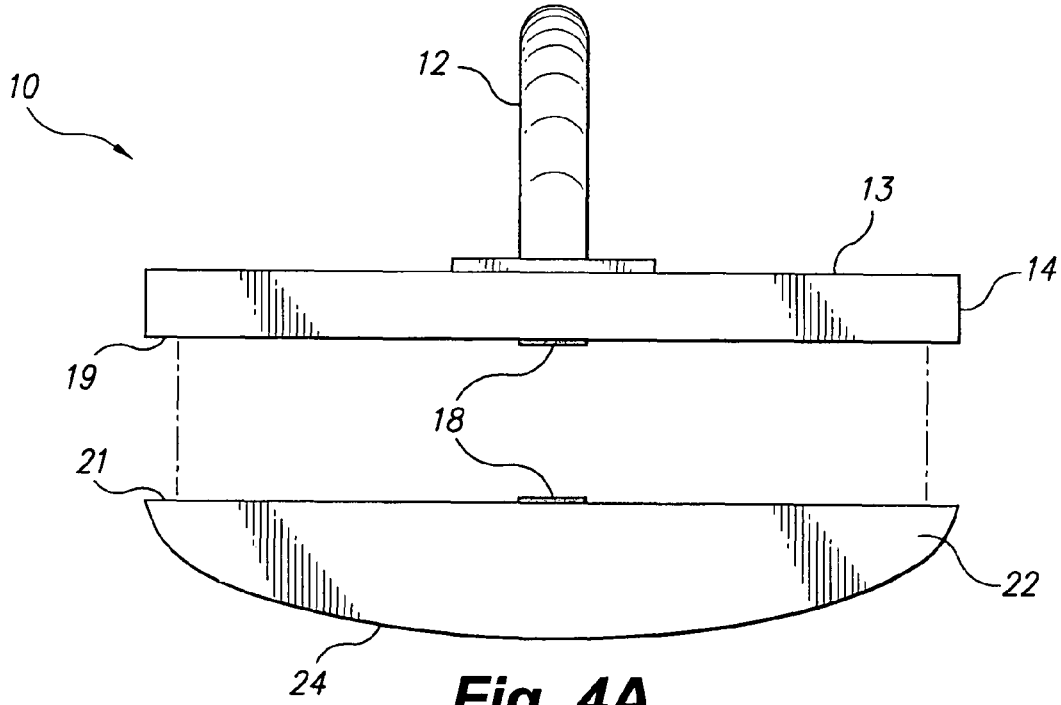
FIG. 4A is a partially exploded front view of another alternative embodiment of a push-up block according to the present invention.
Figure 4B:
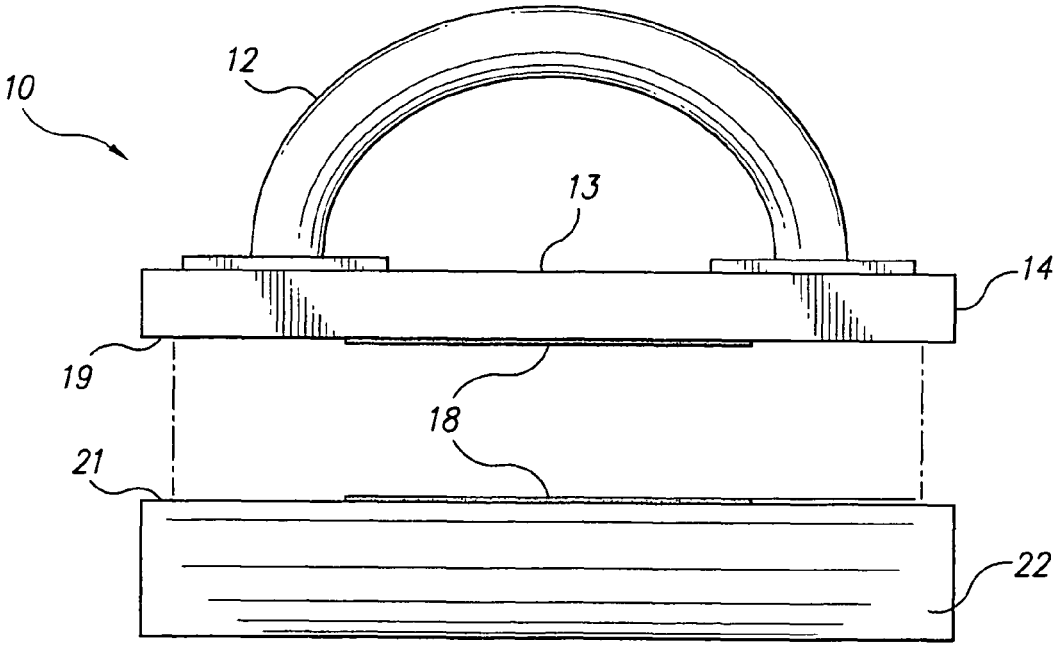
FIG. 4B is a partially exploded side view of the push-up block of FIG. 4A.

In the alternative embodiment of FIGS. 3A and 3B, lower member 20 has an upper surface 26 and a lower surface 28, with the lower surface 28 being substantially pyramidal. In use, vertex 30 rests on the ground. In the further alternative embodiment of FIGS. 4A and 4B, the lower member 22 has an upper surface 21 and an opposed lower surface 24, with the lower surface 24 being substantially semicircular or arcuate. In use, the lowest points on the arcuate lower surface contact the ground. It should be understood that the lower surface of the lower member may have any desired shape, and that FIGS. 2A, 2B, 3A, 3B, 4A and 4B are shown for exemplary purposes only.

Additionally, the upper surface of the lower member is preferably releasably and removably attached to the lower surface 19 of the upper member 14. In FIGS. 2A, 2B, 3A, 3B, 4A and 4B, hook and loop fasteners 18 are shown attached to the lower surface of the upper member and the upper surface of the lower member (with the lower surface of the upper member and the upper surface of the lower member preferably each being substantially planar). It should be understood that any suitable releasable fasteners may be used for releasable and removable mounting of the lower member to the upper member, such as clips, tongue-and-groove fasteners, screws, latches, push-button mechanisms or the like.

Each push-up block 10 may be provided as a kit, with a single upper member 14 and a plurality of lower members 16, 20, 22, in which each lower member or pair of lower members has a distinctive shape. The user may then remove, replace and interchange the lower members, depending upon the type of exercise in which the user wishes to engage.

In use, the user positions each push-block 10 such that the lowest point or points of the lower member rests on the ground. The user then grips the handles 12 and performs a push-up in the conventional manner. Due to the shape of the lower surfaces of the lower members, the user must attempt to maintain balance throughout performance of the push-up, thus providing exercise for muscle groups outside of the typical range of muscle groups used in push-ups. Additionally, the plurality of lower members allow the user to selectively interchange the variously contoured lower members to increase or decrease difficulty level in the exercise.

In addition to the components described above, it is further contemplated to provide a combination carrier and cover. Such a cover would be substantially box-shaped and could be used to removably and releasably cover the lower member, thus providing a flat lower surface, allowing the push-up block to be used for conventional, flat-bottom push-ups. When not in use, the box-shaped cover could be used for storage of the other components.

Figure 5:
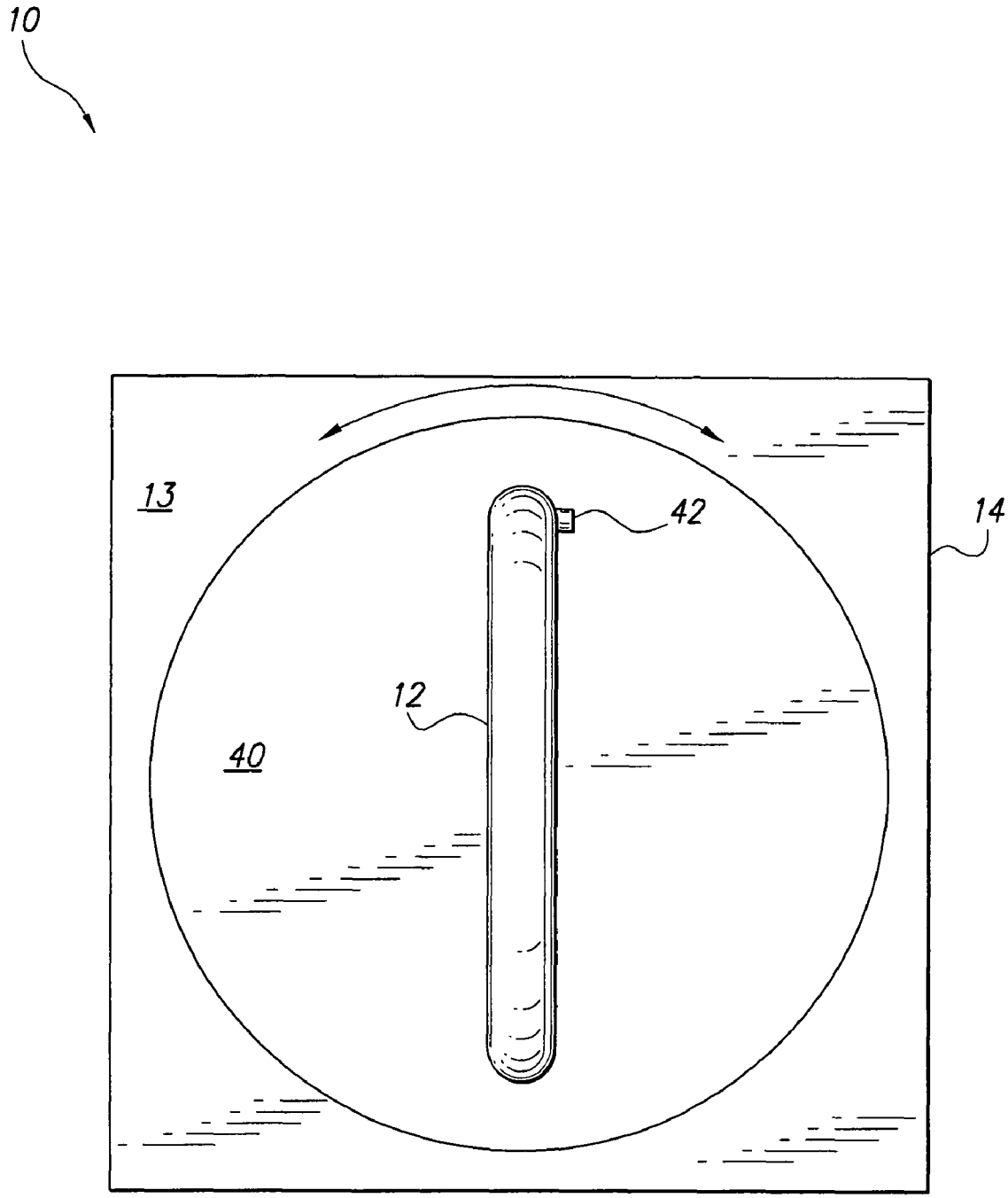
FIG. 5 is a top view of an alternative embodiment of the push-up block according to the present invention.

FIG. 5 illustrates a further alternative, in which handle 12 is mounted to a rotating plate 40, which is rotatably mounted within upper surface 13 of upper member 14. Rotating plate 40 may be mounted within upper surface 13 by any suitable type of rotatable mount, such as a conventional bearing, a lazy Susan-type mounting or the like. Preferably, plate 40 may be locked in place with respect to upper surface 13 via a push-button locking mechanism 42. Any suitable type of locking mechanism may be utilized, such as an elastically biased locking pin or the like. In use, the user may release the push-button locking mechanism 42 to allow plate 40 (and handle 12) to rotate, or may lock the plate 40 in place with respect to upper surface 13, allowing the block 10 to be used in the manner described with relation to the previous embodiments. Although shown as being mounted on handle 12, it should be understood that the push-button of locking mechanism 42 may be mounted on any suitable surface of block 10. As a further alternative, the rotating handle of FIG. 5 may be applied only to a single block; i.e., rather than having an upper member 14 and a lower member 16, the rotating handle 12 may be used in combination with any of the contoured lower members 16, with the handle 12 and rotating plate 40 being mounted on the upper surface thereof.

Figure 6:
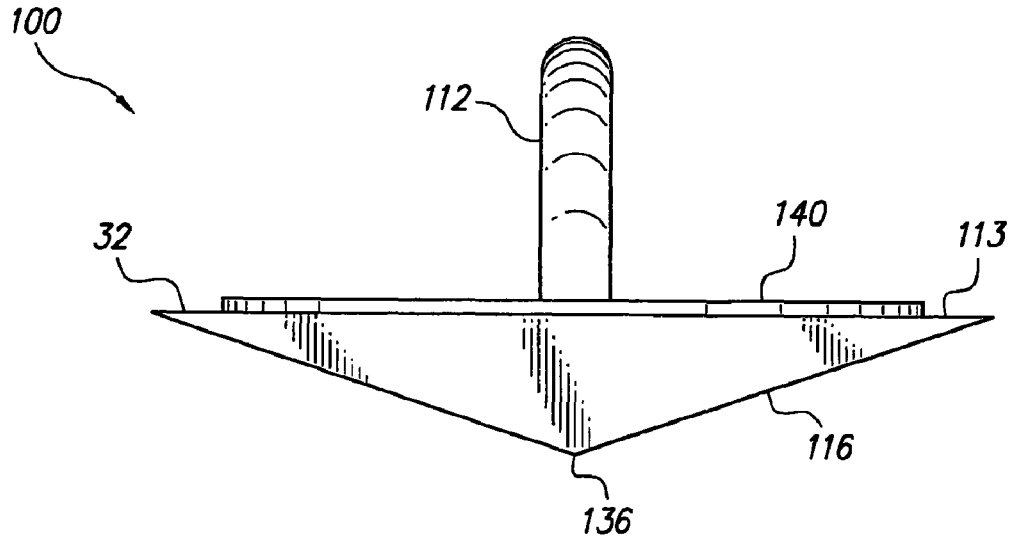
FIG. 6 is a front view of an alternative embodiment of the push-up block according to the present invention.

In the alternative embodiment of FIG. 6, push-up block 100 is formed as a one-piece, integral unit; i.e., member 116, similar to lower member 16 from the previous embodiments, is joined directly to the handle 112 and rotating plate 140. Rotating plate 140 is mounted directly to the upper surface 113 of member 116. It should be understood that member 116 is shown for exemplary purposes only. Member 116 in FIG. 6 is similar to lower member 16 of FIGS. 2A and 2B, including the sharp-angle vertex 36, however member 116 may have any desired contour. Rather than providing a plurality of removable lower members 16, a plurality of differing blocks 100 may be provided, each having a member 116 with a distinct contour, similar to the variety of contours described above with regard to removable and interchangeable lower members 16. As a further alternative, a single lower member may be provided, with the single lower member having a selectively changeable contour.

Figure 7:
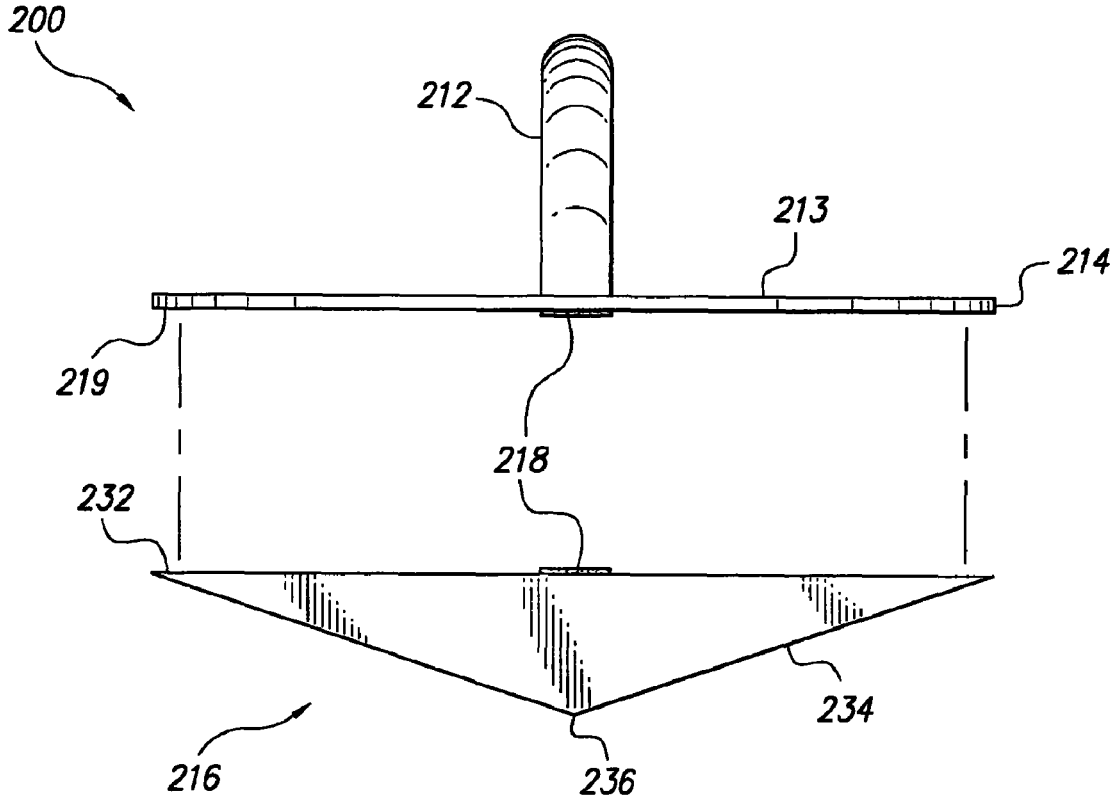
FIG. 7 is a partially exploded front view of another alternative embodiment of the push-up block according to the present invention.

In the further alternative embodiment of FIG. 7, block 200 includes a rotating base 214, similar to upper member 14 of the previous embodiments, but with rotating base 214 being only a substantially thin rotating base. The rotating base 214 has handle 212 mounted thereto and extending therefrom. The rotating base 214 has opposed upper and lower surfaces 213, 219, respectively. A lower member 216 also has opposed upper and lower surfaces 232, 234, respectively. The handle 212 is secured to the upper surface 213 of the rotating base 214, providing the user with a handgrip.

The lower surface 234 of the lower member 216 may have various shapes, but is convex so that at least one lowest point thereof contacts the support surface when the push-up block 200 is in use. In the example of FIG. 7, the lower surface 234 may be substantially V-shaped, forming a triangular wedge, with vertex 236 resting on the ground during use. The contacting surface of the lower member is preferably formed from, or coated with, a non-skid material, such as rubber or the like, for frictionally engaging the support surface. In FIGS. 6 and 7, the locking mechanism of FIG. 5 may further be utilized for selectively locking rotation of the handle with respect to the member 116 or lower member 216.

It is to be understood that the present invention is not limited to the embodiments described above, but encompasses any and all embodiments within the scope of the following claims.

We claim:

1. A push-up block, comprising:

an upper member having opposed upper and lower surfaces;

a handle extending upwardly from the upper surface of the upper member;

a lower member having opposed upper and lower surfaces, the lower surface thereof having a contoured surface such that the lowest point thereof defines a vertex contacting a support surface when the push-up block is in use; and means for releasably securing the upper surface of the lower member to the lower surface of the upper member.

2. The push-up block as recited in claim 1, wherein said means for releasably securing the upper surface of the lower member to the lower surface of the upper member comprises hook and loop fasteners.

3. The push-up block as recited in claim 1, wherein the lower surface of the lower member is substantially V-shaped.

4. The push-up block as recited in claim 1, wherein the lower surface of the lower member is substantially pyramidal.

5. The push-up block as recited in claim 1, wherein said handle is rotatable with respect to the upper surface of said upper member.

6. The push-up block as recited in claim 5, wherein said handle is mounted on a rotating plate, said rotating plate being rotatably mounted on the upper surface of said upper member.

7. The push-up block as recited in claim 6, further comprising means for selectively locking the rotating plate in place with respect to the upper surface of said upper member.

8. A push-up block kit, comprising:

an upper member having opposed upper and lower surfaces;

a handle secured to the upper surface of the upper member and extending upwardly therefrom;

a plurality of lower members each having opposed upper and lower surfaces, the lower surface of each of the lower members being distinctly contoured so that the lowest point thereof contacts a support surface when the push-up block is in use, wherein at least one of the lower surfaces defines a vertex; and means for releasably securing the upper surface of one of the lower members to the lower surface of the upper member, whereby the lower members are selectively interchangeable to exercise different muscle group.

9. The push-up block kit as recited in claim 8, wherein said means for releasably securing the upper surface of one of the lower members to the lower surface of the upper member comprises hook and loop fasteners.

10. The push-up block kit as recited in claim 8, wherein the lower surface of at least one of the lower members is substantially V-shaped.

11. The push-up block kit as recited in claim 8, wherein the lower surface of at least one of the lower members is substantially semicircular.

12. The push-up block kit as recited in claim 8, wherein the lower surface of at least one of the lower members is substantially pyramidal.

13. The push-up block kit as recited in claim 8, wherein said handle is rotatable with respect to the upper surface of said upper member.

14. The push-up block kit as recited in claim 13, wherein said handle is mounted on a rotating plate, said rotating plate being rotatably mounted on the upper surface of said upper member.

15. The push-up block kit as recited in claim 14, further comprising means for selectively locking the rotating plate in place with respect to the upper surface of said upper member.

16. A push-up block, comprising:

an upper member having opposed upper and lower surfaces;

a rotating base plate, the rotating base plate being rotatably mounted on the upper surface of said upper member;

a handle extending upwardly from an upper surface of rotating base plate;

a lower member having opposed upper and lower surfaces, the lower surface thereof having a contoured surface such that the lowest point thereof contacts a support surface when the push-up block is in use, a lower surface of said rotating base plate being mounted on the upper surface of said lower member, said handle being selectively rotatable with respect to the upper surface of said lower member; and means for selectively locking said handle in place with respect to the upper surface of said lower member.

17. The push-up block as recited in claim 16, further comprising means for releasably securing the upper surface of the lower member to the lower surface of the rotating base.

18. The push-up block as recited in claim 16, wherein the lower surface of the lower member is substantially V-shaped.

19. The push-up block as recited in claim 16, wherein the lower surface of the lower member has a contour selected from the group consisting of: a substantially V-shaped contour, a substantially semicircular contour, and a substantially pyramidal contour.

* * * * *